US005513422A

United States Patent [19]

Wen-Lung

[11] Patent Number: 5,513,422

[45] Date of Patent: May 7, 1996

[54] CROWN BUTTON OF A CAP

[76] Inventor: Ho Wen-Lung, No. 30-1, Ta-Chuan Street, Taichung, Taiwan

[21] Appl. No.: 330,065

[22] Filed: Oct. 26, 1994

[51] Int. Cl.[6] ..... A44B 1/38; A44B 1/04

[52] U.S. Cl. ..... 24/92; 24/113 R; 24/113 MP

[58] Field of Search ..... 24/90.1, 92, 103, 24/108, 94, 113 R, 113 MP; 40/301

[56] References Cited

U.S. PATENT DOCUMENTS

| | | | |
|---|---|---|---|
| 3,725,980 | 4/1973 | Burgio | 24/108 |
| 4,457,050 | 7/1984 | Kanzaka | 24/108 |
| 4,541,148 | 9/1985 | Watanabe | 24/108 |
| 4,683,621 | 8/1987 | Watanabe | 24/92 X |
| 4,782,559 | 11/1988 | Sparrow | 24/108 X |
| 4,943,197 | 7/1990 | Baritz | 24/113 MP X |
| 5,093,965 | 3/1992 | Mauras et al. | 24/92 X |

*Primary Examiner*—Peter M. Cuomo
*Assistant Examiner*—Robert J. Sandy
*Attorney, Agent, or Firm*—Browdy and Neimark

[57] ABSTRACT

A cap crown button comprises a female retaining body, a male retaining body and a covering body. The female retaining body is provided with a retaining hole having at the upper end thereof a receiving space in which a connection portion, a receiving portion and a tapered portion are disposed. When the pin column of the male retaining body is inserted into the retaining hole of the female retaining body, the tapered head of the pin column of the male retaining body is rested against the tapered portion such that the bottom edge of the tapered head of the male retaining body is received in the receiving portion of the retaining hole. The retaining effect of the male retaining body and the female retaining body is therefore effectively enhanced without causing the tapered head of the male retaining body to pierce through the female retaining body.

2 Claims, 2 Drawing Sheets

CROWN BUTTON OF A CAP

FIELD OF THE INVENTION

The present invention relates generally to a cap, and more particularly to a crown button of the cap.

BACKGROUND OF THE INVENTION

As shown in FIG. 1, a cap crown button 10 of the prior art comprises a female retaining body 11, a fastening element 12, and a male retaining body 13. The female retaining body 11 is provided at the bottom thereof with a projected column 14 which is in turn provided therein with an inner hole 15 having the same hole diameter throughout the hole and having a protruded ring 16 of an inversely hooked and slant construction. The male retaining body 13 is provided with a pin column 17 having a recessed ring 18 of a bevel construction. In use, the female retaining body 11 is covered on the outer periphery thereof with a piece of decorative cloth, which is not shown in the drawing. The peripheral edge of the decorative cloth is so rolled as to be located in the inner periphery of the female retaining body 11 before the fastening element 12 is retained on the projected column 14 of the female retaining body 11. The peripheral edge of the decorative cloth is then attached securely to the inside of the female retaining body 11. In the meantime, the pin column 17 of the male retaining body 13 is retained securely in the inner hole 15 of the female retaining body 11. As a result, the cap crown button 10 is fastened esthetically to the seam of the cap gores.

The cap crown button 10 described above is made integrally of a plastic material. In the process of making the cap crown button 10, the protruded ring 16 of the inner hole 15 of the female retaining body 11 is vulnerable to damage caused by the molding tool in view of the fact that the molding tool can not be easily removed from the inner hole 15. The similar situation can also happen to the male retaining body 13. As a result, the retaining effect of the female retaining body 11 and the male retaining body 13 is often undermined.

In order to overcome the afore-mentioned defect of the cap crown button 10 of the prior art, this inventor of the present invention disclosed a cap crown button, which is shown in FIG. 2 and is composed of a male retaining body 21, a female retaining body 22, and a covering body 23. The female retaining body 22 is covered with the covering body 23 which is in turn covered with a piece of a decorative cloth 24. The female retaining body 22 is provided therein with an inner hole 25 of a through construction to facilitate the disengagement of the molding tool with the inner hole 25 and to provide the inner hole 25 with a retaining portion 26. The male retaining body 21 is provided with a pin column 27 having a tapered head 28. The male and the female retaining bodies 21 and 22 are held together such that the tapered head 28 is retained in the retaining portion 26. However, such a cap crown button as described above is also defective in design in that the covering body 23 is often bulged by the tapered head 28 of the male retaining body 21 when the pin column 27 of the male retaining body 21 is forced into the inner hole 25 of the female retaining body 22, as illustrated in FIG. 2 in which the tapered head 28 is indicated by the dotted lines when the tapered head 28 is caused to bulge the covering body 23. The esthetic quality of the cap crown button is undermined by the bulged covering body 23.

SUMMARY OF THE INVENTION

It is therefore the primary objective of the present invention to provide a-cap crown button with an improved female retaining body whose structural integrity is not undermined during the process of molding the cap crown button.

It is another objective of the present invention to provide a cap crown button with an improved male retaining body which does not cause a damage to the covering body of the cap crown button when the male retaining body is joined with the female retaining body.

The foregoing objectives of the present invention are attained by an improved cap crown button, which comprises a female retaining body, a male retaining body and a covering body. The female retaining body is provided therein with a retaining hole having at the upper end thereof a receiving space in which a connection portion, a receiving portion and a tapered portion are disposed. When the pin column of the male retaining body is inserted into the retaining hole of the female retaining body, the tapered head of the pin column of the male retaining body is rested against the tapered portion of the retaining hole of the female retaining body such that the bottom edge of the tapered head of the male retaining body is received in the receiving portion of the retaining hole. The retaining effect of the male retaining body and the female retaining body is therefore effectively enhanced without causing the tapered head of the male retaining body to pierce through the female retaining body.

DETAILED DESCRIPTION OF THE INVENTION

Figure 1:
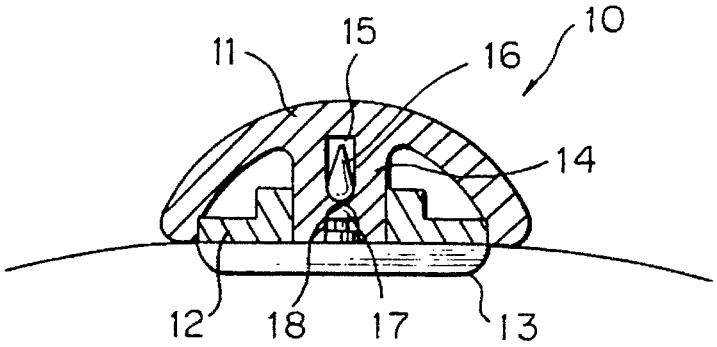
FIG. 1 (PRIOR ART)
FIG 1 shows a schematic view of the construction of prior art cap crown button.
Figure 2:
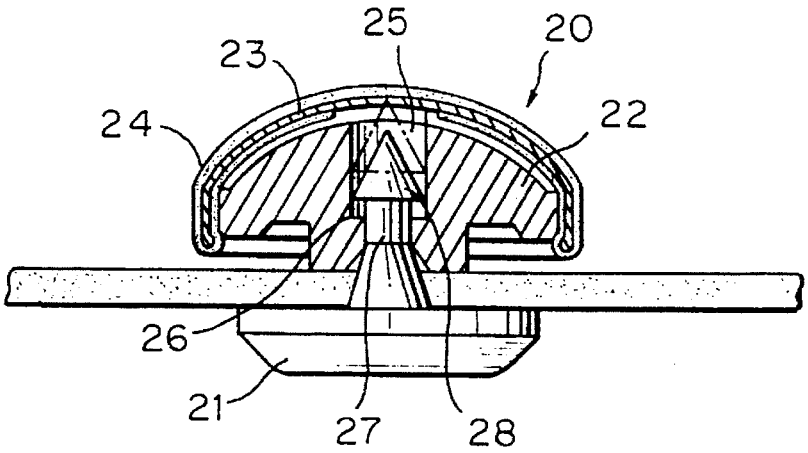
FIG. 2 (PRIOR ART)
FIG. 2 shows a schematic view of the construction of another prior art cap crown button.
Figure 3:
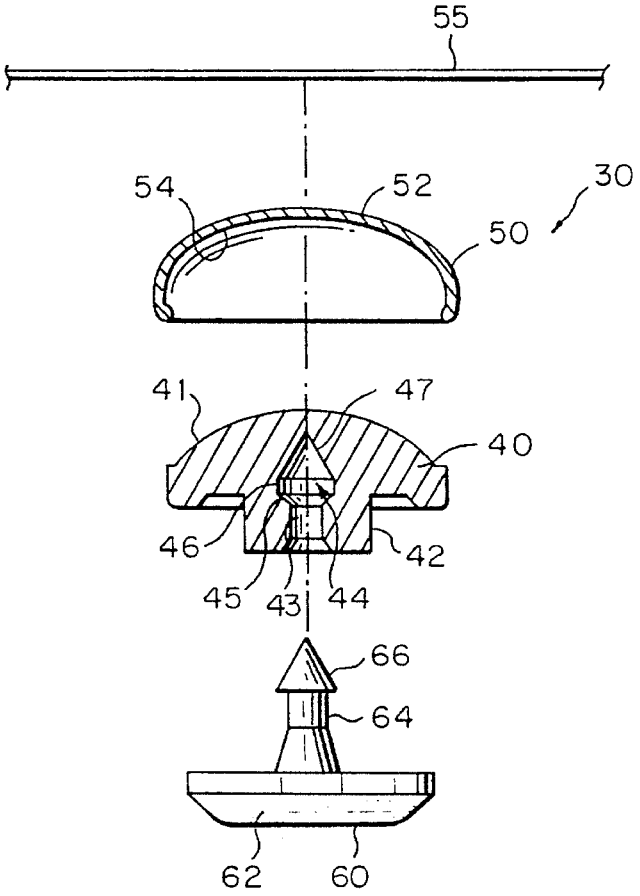
FIG. 3 shows an exploded view of a cap crown button of the present invention.

As shown in FIG. 3, a cap crown button 30 embodied in the present invention comprises a female retaining body 40, a male retaining body 60, and a covering body 50 of a metal material. The female retaining body 40 and the male retaining body 60 are made of a plastic material by injection molding.

The female retaining body 40 is provided at the top thereof with an arcuate surface 41 of a smooth construction and at the bottom thereof with a projection 42 extending downwards and having axially a retaining hole 43. Located at the top of the retaining hole 43 is a receiving space 44 in which a connection portion 45, a receiving portion 46, and a tapered portion 47 are disposed. The connection portion 45 is located at the midsegment of the retaining hole 43 and has an inner diameter which increases gradually toward the upper portion thereof, i.e., the inner surface of the connection portion is shaped as an inverted frustum of a cone. The receiving portion 46 is located immediately over the connection portion 45 such that the receiving portion 46 is connected with the connection portion 45 and these portions meet at a circular juncture, which is in cross section an angular portion of the female retaining body. The receiving portion 46 has a diameter greater than the diameter of the retaining hole 43. The tapered portion 47 is located immediately over the receiving portion 46 such that the tapered portion 47 forms the top end of the retaining hole 43.

The covering body 50 of a bowl shape is provided with a convex surface 52 and a concave surface 54. The convex surface 52 is covered with a decorative cloth 55 such that the periphery of the decorative cloth 55 is folded into the concave surface 54. The covering body 50 is disposed on the arcuate surface 41 of the female retaining body 40 such that the decorative cloth 55 is fastened securely between the covering body 50 and the female retaining body 40.

The male retaining body 60 has a base 62 which is provided centrally with a pin column 64 extending upwards and having at the top thereof a tapered (conical) head 66 with an outer diameter greater than the outer diameter of the pin column 64. The lowermost circular edge of the head 66, as seen in FIG. 3, is formed between the conical upper surface of the head 66 and the generally flat base of the head 66 (at the juncture of the head 66 and the pin column 64). This circular edge, formed by two surfaces, is generally sharp.

Figure 4:
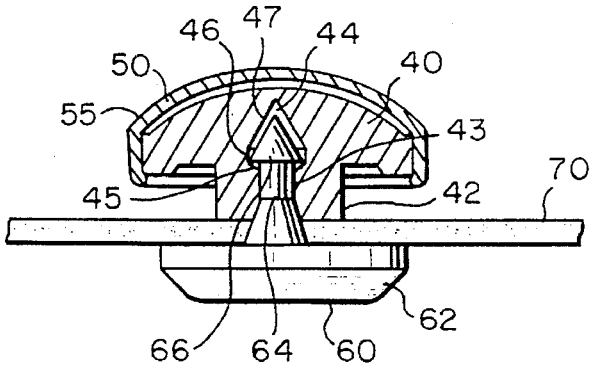
FIG. 4 shows a schematic view of the cap crown button in combination according to the present invention as shown in FIG. 3.

In combination, the pin column 64 of the male retaining body 60 is inserted into the retaining hole 43 of the female retaining body 40 after piercing through a cap crown 70, as shown in FIG. 4. The pin column 64, of the male retaining body 60 is forced into the retaining hole 43 of the female retaining body 40 such that the tapered head 66 is rested against the tapered portion 47 of the female retaining body 40. The tapered portion 47 serves to absorb the impact energy of the pin column 64 which is forced into the retaining hole 43 of the female retaining body 40, thereby preventing the tapered head 66 from piercing through the female retaining body 40.

As the pin column 64 of the male retaining body 60 is retained securely in the retaining hole 43 of the female retaining body 40, the tapered head 66 of the male retaining body 60 is received in the receiving portion 46 of the female retaining body 40. The tapered head 66 has an outer diameter corresponding to the outer diameter of the receiving portion 46. The retaining effect of the female retaining body 40 and the male retaining body 60 is greatly enhanced in view of the fact that the bottom portion of the tapered head 66 is retained securely in the angular portion located between the receiving portion 46 and the connection portion 45.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A cap crown button comprising:

a female retaining body provided therein with a retaining hole;

a male retaining body having a base integral with a pin column, the pin column provided with a head integral with the pin column, the head having a tapered conical construction including an apex angle and being dimensioned to fit securely into said retaining hole of said female retaining body, said head including a lowermost circular edge having an edge diameter greater than a pin column diameter; and a covering body having a convex surface covered with a decorative cloth and further having a concave surface, said covering body being disposed on a periphery of said female retaining body such that a peripheral edge of said decorative cloth is secured to a space located between said concave surface and a periphery of said female retaining body;

wherein said retaining hole of said female retaining body is provided at a top portion thereof with a receiving space which comprises:

a tapered connection portion located at a midsegment of said retaining hole, said connection portion being shaped generally as an inverted cone;

a receiving portion located over said connection portion and connected with said connection portion, said receiving portion having a diameter greater than a smallest diameter of said retaining hole; and a tapered portion located over said receiving portion, said tapered portion including substantially the apex angle such that said tapered portion forms a top of said retaining hole for absorbing an impact energy of said head of said pin column which is inserted into said retaining hole;

wherein said pin column of said male retaining body is retained securely in said retaining hole of said female retaining body such that said head of said pin column is received in said receiving portion, and that the circular edge of said head is retained securely at a circular juncture located between said receiving portion and said connection portion.

2. A cap crown button comprising:

a female retaining body provided therein with a retaining hole;

a male retaining body having a base integral with a pin column, the pin column provided with a head integral with the pin column, the head having a tapered conical construction including an apex angle and being dimensioned to fit securely into said retaining hole of said female retaining body, said head including a lowermost circular edge having an edge diameter greater than a pin column diameter; and a covering body having a convex surface covered with a decorative cloth and further having a concave surface, said covering body being disposed on a periphery of said female retaining body such that a peripheral edge of said decorative cloth is secured to a space located between said concave surface and a periphery of said female retaining body;

wherein said retaining hole of said female retaining body is provided at a top portion thereof with a receiving space which comprises:

a tapered connection portion located at a midsegment of said retaining hole, said connection portion being shaped generally as an inverted cone;

a receiving portion located over said connection portion and connected with said connection portion, said receiving portion having a diameter greater than a smallest diameter of said retaining hole; and a tapered portion located over said receiving portion, said tapered portion including substantially the apex angle such that said tapered portion forms a top of said retaining hole for absorbing an impact energy of said head of said pin column which is inserted into said retaining hole;

wherein said pin column of said male retaining body is retained securely in said retaining hole of said female retaining body such that said head of said pin column is received in said receiving portion, and that the circular edge of said head is retained securely at a circular juncture located between said receiving portion and said connection portion;

wherein said female retaining body includes a projection coaxial with said retaining hole;

wherein said pin column of said male retaining body includes a tapered skirt adjacent the base and the female retaining body includes an arcuate chamfer at an outer end of the retaining hole thereof, said tapered skirt and said chamfer being similarly tapered, such that said tapered skirt and said chamfer are pressed together upon assembly of the button;

wherein said female retaining body includes an arcuate surface fitting within an interior of said covering body; and wherein said base includes a rounded bottom.

* * * * *